United States Patent [19]

Tanaka et al.

[11] Patent Number: 4,541,399

[45] Date of Patent: Sep. 17, 1985

[54] BREATHER ARRANGEMENT FOR INTERNAL COMBUSTION ENGINE

[75] Inventors: Toshimitsu Tanaka, Yamaguchi; Ryoji Abe; Koji Asanomi, both of Hiroshima, all of Japan

[73] Assignee: Mazda Motor Corporation, Hiroshima, Japan

[21] Appl. No.: 584,892

[22] Filed: Feb. 29, 1984

[30] Foreign Application Priority Data

Mar. 3, 1983 [JP] Japan ..... 58-35508
Mar. 14, 1983 [JP] Japan ..... 58-41926

[51] Int. Cl.[4] ..... F02M 25/06
[52] U.S. Cl. ..... 123/573; 123/572
[58] Field of Search ..... 123/572, 573, 574, 41.86

[56] References Cited

U.S. PATENT DOCUMENTS 2,493,617 1/1950 Chubbuch ..... 123/573
2,796,853 6/1957 Ranst ..... 123/572
3,730,160 5/1973 Hughes ..... 123/572
3,946,710 3/1976 Albano ..... 123/573
3,949,719 4/1976 Bellanca ..... 123/572
4,156,406 5/1979 Brandau ..... 123/573

*Primary Examiner*—Ronald H. Lazarus
*Attorney, Agent, or Firm*—Burns, Doane, Swecker & Mathis

[57] ABSTRACT

A V-type internal combustion engine having cam shafts respectively provided in first spaces defined between cylinder heads and head covers of a pair of upwardly diverging cylinder banks and a breather arrangement which includes a pressure buffer chamber provided between the cylinder banks of a cylinder block and having side walls constituted by cylinder block walls of said cylinder banks so as to be closed at its upper portion and communicated with an interior of a crankcase, and a communicating passage for communicating said pressure buffer chamber with an intake passage at a downstream of a throttle valve, and a baffle plate provided in said pressure buffer chamber to confront the open end of said communicating passage.

11 Claims, 7 Drawing Figures

BREATHER ARRANGEMENT FOR INTERNAL COMBUSTION ENGINE

BACKGROUND OF THE INVENTION

The present invention generally relates to a crankcase ventilating system and more particularly, to an improved breather arrangement for relieving or stabilizing pressure variation within a crankcase of a V-type internal combustion engine of an OHC (Overhead cam shaft) system.

Commonly, in a reciprocating type internal combustion engine, there is a tendency that the pressure within a crankcase varies according to revolutions of the engine due to an increase in a leakage amount of the so-called blow-by gas which leaks out from combustion chambers into the crankcase through clearances between piston rings and cylinder walls in the explosion and expansion strokes, and also, due to a pumping action of pistons, etc. Accordingly, in the case where the interior of the crankcase is directly communicated with an intake passage so as to subject the blow-by gas within the crankcase to combustion in the combustion chambers simultaneously with a combustible charge, oil contained in the blow-by gas is brought into the intake passage by a large amount, following the pressure variation within the crankcase, thus resulting in such a problem that the oil consumption is undesirably increased. Therefore, there has been employed a breather arrangement which is adapted to alleviate the pressure variation within the crankcase by providing a breather chamber (i.e. a pressure buffer chamber) communicated with the interior of the crankcase.

Incidentally, as a breather arrangement of the above described kind for a V-type engine, there has conventionally been proposed, for example, in Japanese Patent Publication Tokkosho No. 52-39983, an arrangement in which cavities as breather chambers are formed by casting at outer sides of both inclined banks for the engine crankcase.

In the known arrangement as described above, however, since the breather chambers are formed at the respective outer sides of the inclined banks, if the volume of each of the breather chambers is increased in order to improve an oil separating function thereof with respect to the blow-by gas, the portions for the breather chambers are expanded outwardly to increase the engine dimensions and consequently, installation of various auxiliary appliances at the side portions of the engine is undesirably limited. The disadvantage as described above is particularly conspicuous in the V-type engine of the OHC system in which the amount of leakage of the blow-by gas tends to be large owing to high speed revolutions.

SUMMARY OF THE INVENTION

Accordingly, an essential object of the present invention is to provide an improved breathing arrangement for an internal combustion engine, which is so arranged that, by providing a pressure buffer chamber through effective utilization of a dead space in a V-type engine of an OHC system, with the pressure buffer chamber being communicated with an intake passage, the volume of said pressure buffer chamber is maintained to be sufficiently large without increasing dimensions of the V-type engine, whereby the pressure variation within the crankcase is alleviated in an efficient manner so that the oil separating function with respect to the blow-by gas is improved for reduction of an oil amount to be drawn into the intake passage.

Another important object of the present invention is to provide a breathing arrangement of the above described type, which is simple in construction and stable in functioning at high reliability, and can be readily in corporated into V-type engines of this kind at low cost.

In accomplishing these and other objects, according to one preferred embodiment of the present invention, there is provided a V-type internal combustion engine having cam shafts respectively provided in first spaces defined between cylinder heads and head covers of a pair of upwardly diverging cylinder banks, and a breather arrangement which comprises a pressure buffer chamber provided in a second space defined between the cylinder banks of a cylinder block and including side walls constituted by cylinder block walls of the cylinder banks so as to be closed at its upper portion and communicated with an interior of a crankcase, and a communicating passage for communicating the pressure buffer chamber with an intake passage at a downstream of a throttle valve, and a baffle plate provided in the pressure buffer chamber to confront an open end of the communicating passage.

Since the present invention is applied to the V-type engine of the OHC system in which cam shaft supporting and valve driving systems are located in spaces defined by cylinder heads and head covers, a large space can be obtained for the pressure buffer chamber, with a configuration of an inverted triangle having a main oil gallery formed at its apex. In connection with the above, if the engine to be applied is of an OHV(Overhead valve) system, not only the pressure buffer space is reduced to avoid cam shafts, but valve driving systems such as tappets, etc. are exposed into the pressure buffer space to produce pressure variation by the movements thereof at all times, with oil being scattered inside the pressure buffer space due to lubricating oil employed for the valve driving systems, thus resulting in the deterioration of the oil separating function. Therefore, in the present invention applied to the V-type engine of the OHC system, the pressure variation in the pressure buffer space is small, with a less scattering of oil therein.

By the arrangement according to the present invention as described above, the dead space peculiar to the V-type engine of the OHC system is effectively utilized as the pressure buffer chamber, with said engine being maintained compact in size, and, through reduction of pressure variation in said pressure buffer chamber, the oil separating function is improved, while, by communicating said pressure buffer chamber with the intake passage through the opening provided with a baffle plate, the oil scattering towards the opening is shielded by the baffle plate, thereby to reduce the oil drawn into the intake passage.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1A:
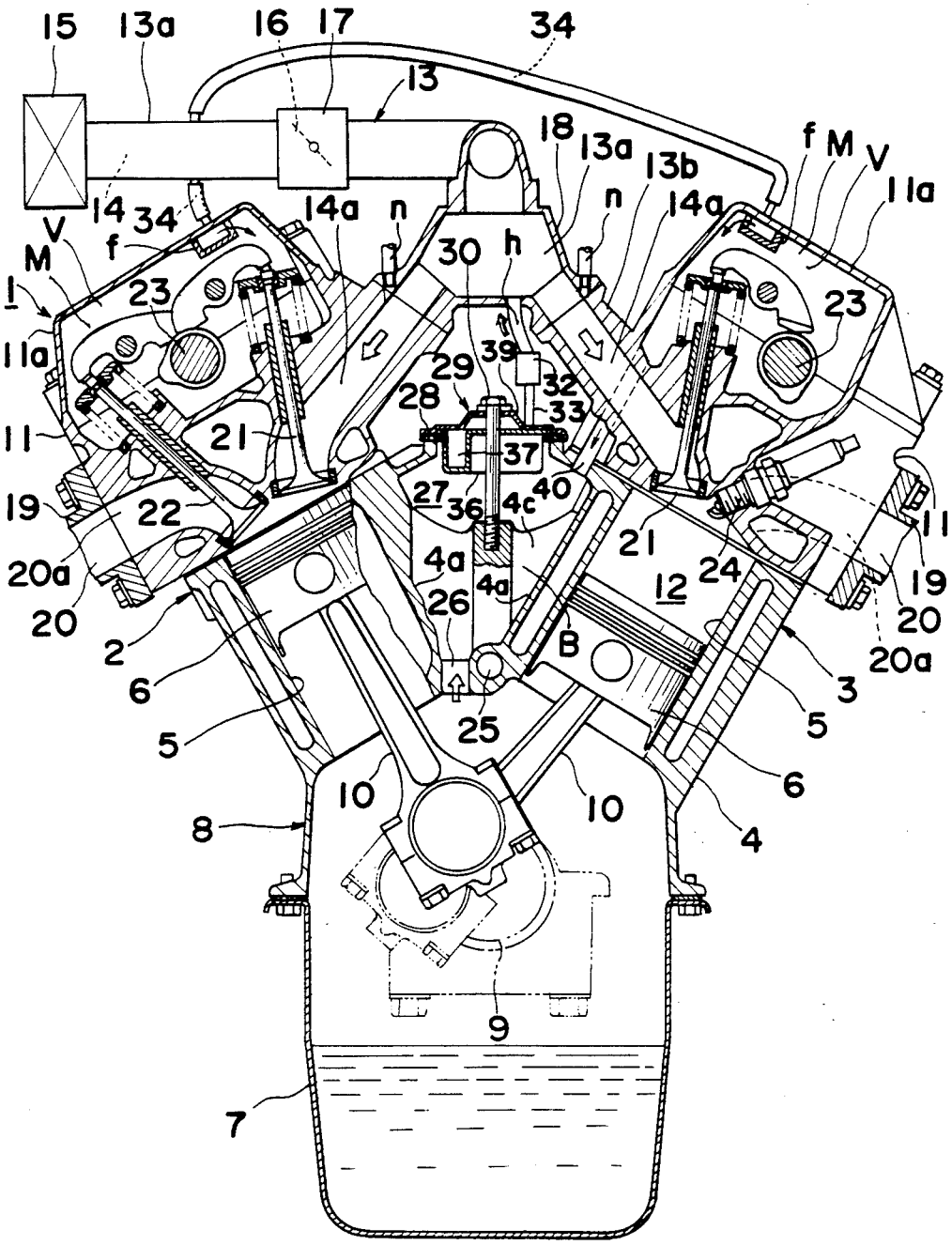
FIG. 1(*a*) is a transverse sectional view of a V-type internal combustion engine taken along a direction at right angles with respect to cylinder rows thereof, FIG. 1(*b*) is a side sectional view showing, on an enlarged scale, a pressure control valve provided in a communicating passage in the arrangement of FIG. 1.

Before the description of the present invention proceeds, it is to be noted that like parts are designated by like reference numerals throughout the accompanying drawings.

Figure 1B:
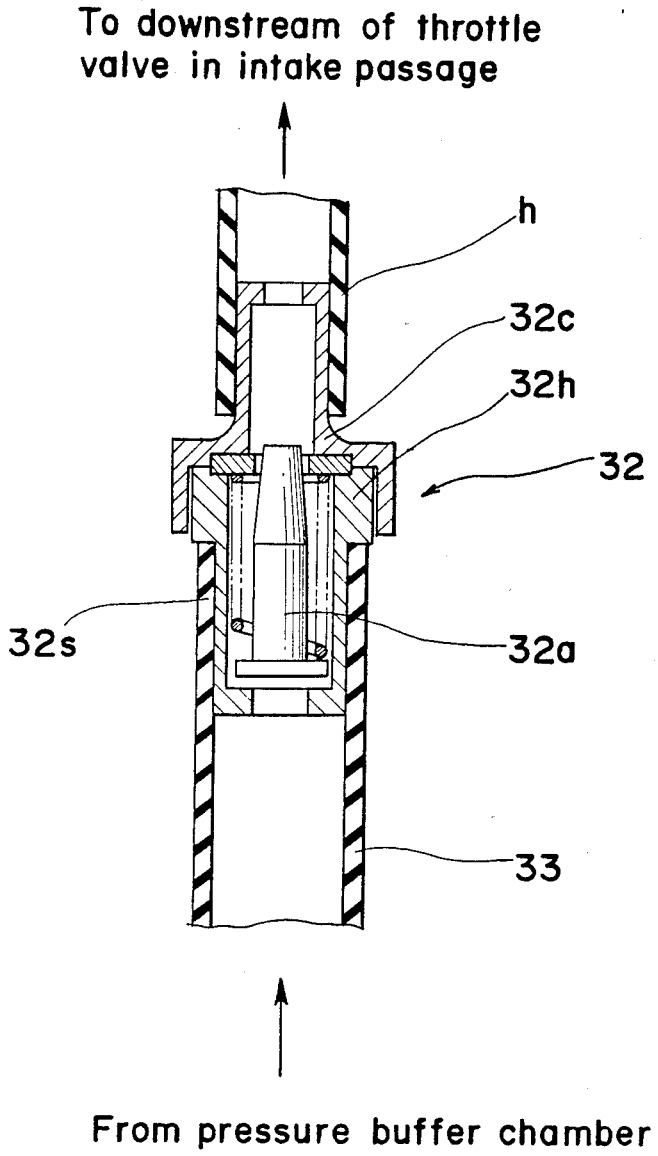

Referring now to the drawings, there is shown, in FIG. 1(*a*), a V-type internal combustion engine of an OHC system, which includes a cylinder block 4 having a pair of banks 2 and 3 oppositely inclined into a V-shape. Each of the banks 2 and 3 is formed with three cylinders 5, thus providing six cylinders in total, in which pistons 6 are respectively accommodated for reciprocation therein. At the under face of the cylinder block 4, there is mounted an oil pan 7 containing oil therein, and a crankcase 8 is constituted by the oil pan 7 and the lower portion of the cylinder block 4. In the crankcase 8, a crankshaft 9 is rotatably supported, to which the pistons 6 are connected through connecting rods 10 so as to be driven in a known manner. Meanwhile, cylinder heads 11 are air-tightly mounted respectively on the upper faces of the banks 2 and 3, and thus, combustion chambers 12 are formed in portions surrounded by the respective cylinder heads 11, cylinders 5 and pistons 6. On the cylinder heads 11, there are further secured head covers 11*a* so as to define spaces V therebetween for accommodating therein valve driving mechanisms M to be described later. There is also provided an intake pipe 13 which forms an intake passage 14 for supplying the combustible charge into the combustion chamber 12. The intake pipe 13 includes an intake manifold portion 13*a* connected, at its upstream end, to an air cleaner 15 and having a carburettor 17 provided with a throttle valve 16 on the way, and a plurality of pipe portions 13*b* branched from the downstream end of the manifold portion 13*a* through a surge tank 18, with the respective pipe portions 13*b* being communicated with the corresponding combustion chambers 12 of the cylinders 5 through intake ports 14*a* as the downstream end of the intake passage 14, with fuel injection nozzles n being provided for the intake ports 4*a* as shown. Exhaust pipes 19 are provided to constitute exhaust passages 20 for discharging exhaust gases in the respective combustion chambers 12 to the outside. Further provided are intake valves 21 for selectively opening or closing the openings of the intake ports 14*a* into the combustion chambers 12, and exhaust valves 22 for selectively opening or closing openings of exhaust ports 20*a* into the combustion chambers 12 as the upstream end of the exhaust passages 20, and the above intake and exhaust valves 21 and 22 are arranged to be driven for opening or closing by the valve driving mechanism M including cam shafts 23 mounted in the spaces V between the head covers 11*a* and the cylinder heads 11, and driven for rotation by the crankshaft 9 described earlier, and thus, the engine 1 is formed into the OHC system. There are also provided ignition plugs 2 and a main oil gallery 25 in the cylinder block 4 as shown.

Figure 2:
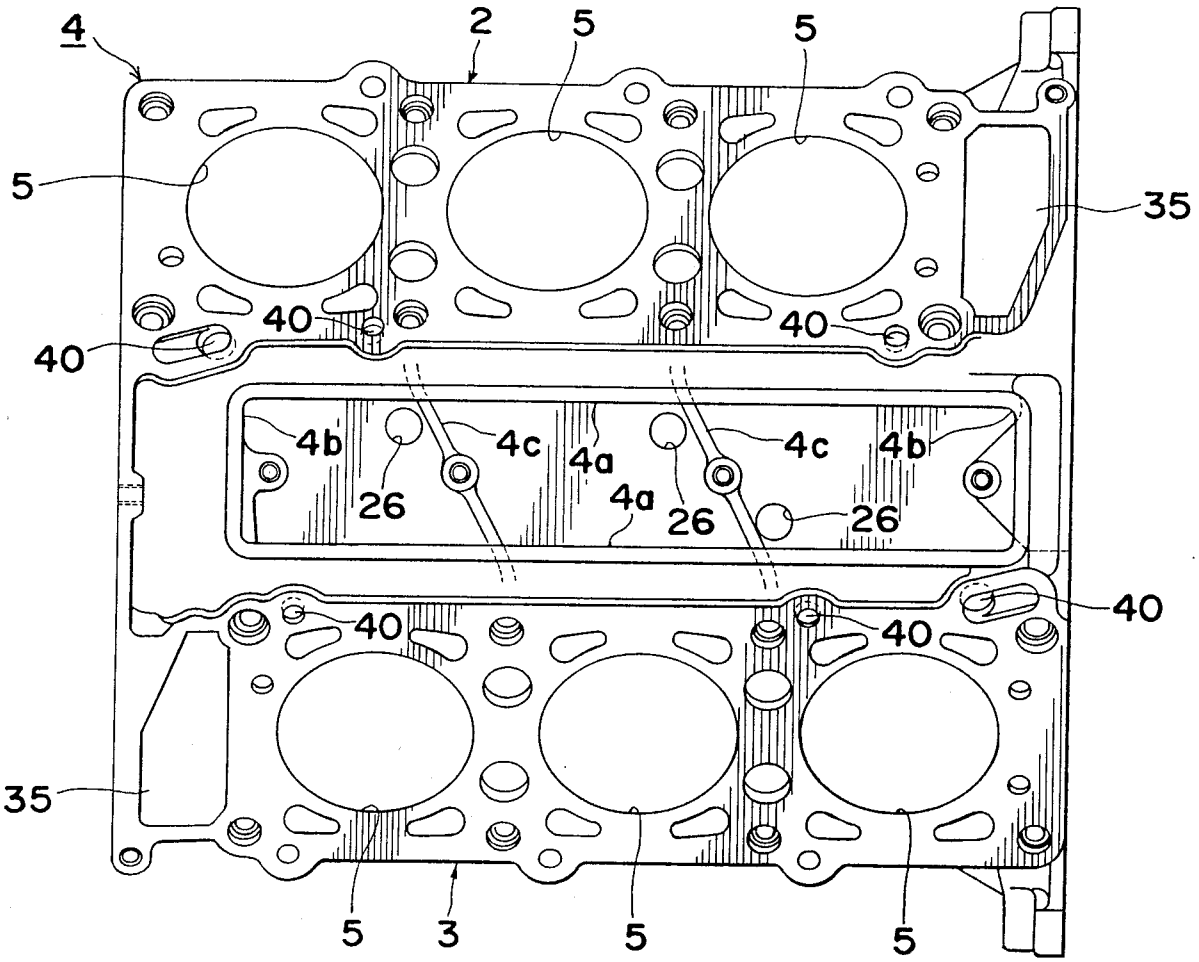
FIG. 2 is a top plan view of a cylinder block for the V-type internal combustion engine of FIG. 1.
Figure 3:
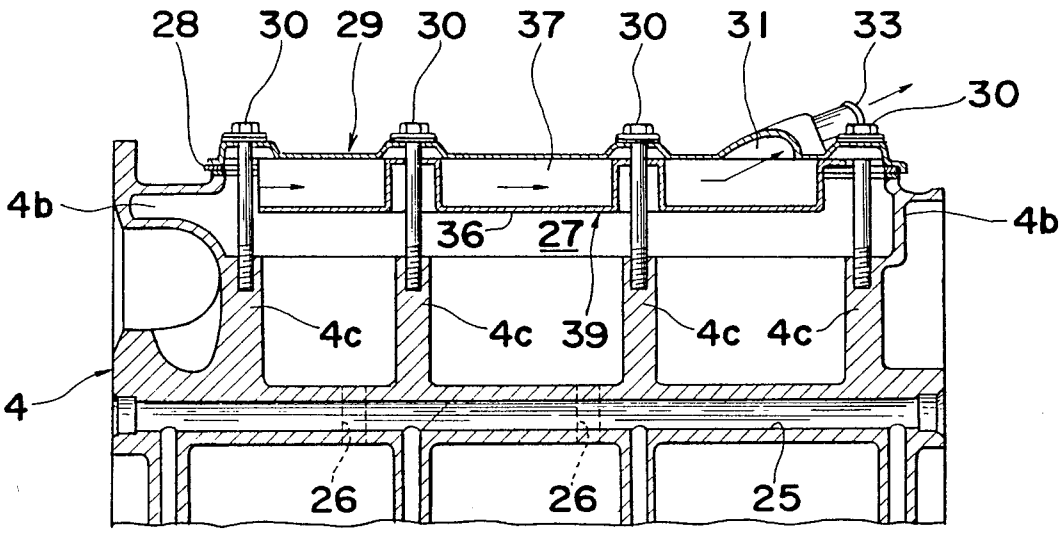
FIG. 3 is a longitudinal sectional view of the pressure buffer chamber taken in a direction of rows of cylinders.
Figure 4:
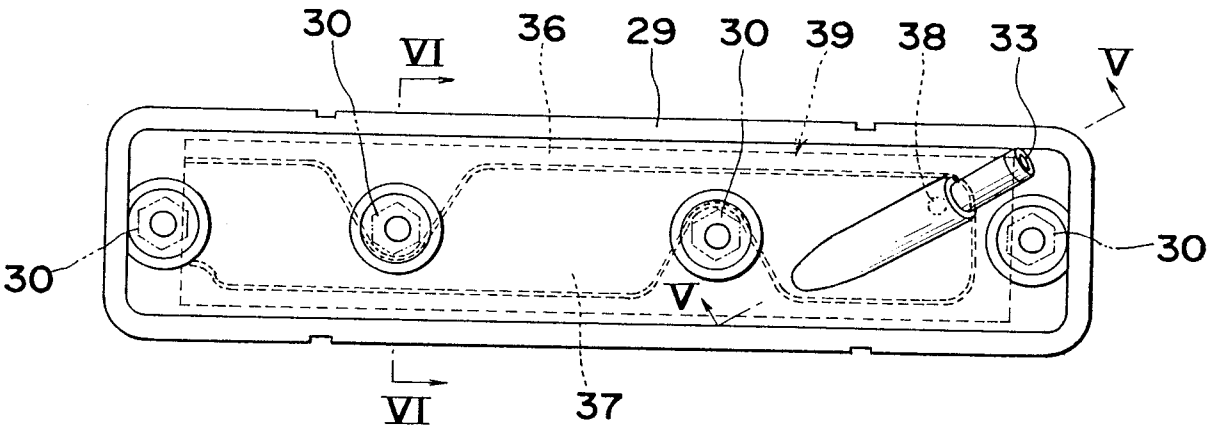
FIG. 4 is a top plan view of a lid member employed in the arrangement of FIG. 1, and FIGS. 5 and 6 are respectively cross sectional views taken along the lines V—V and VI—VI in FIG. 4.
Figure 6:
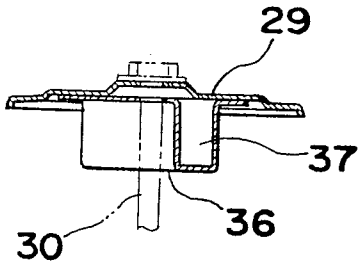

Moreover, between the cylinder walls of the cylinder banks 2 and 3 for the cylinder block 4, a space B having an approximately triangular cross section is defined, with the main oil gallery 25 being provided to extend through the wall constituting the cylinder block 4 in an apex portion at the lower portion of the triangular cross section. In the space B, there is formed an enclosed pressure buffer chamber 27 communicated with the interior of the crankcase 8 through a plurality of communicating holes 26 (FIGS. 2 and 3) of a comparatively small diameter, so that variation of pressure within the crankcase 8 due to an increase of leakage amount, in the explosion and expansion strokes, of the blow-by gas leaking from the respective combustion chambers 12 into the crankcase 8, and also, due to pumping action of the respective pistons 6, are alleviated by said pressure buffer chamber 27. Lateral side walls of the pressure buffer chamber 27 are formed by confronting wall portions 4*a* of the cylinder block 4 for the inclined banks 2 and 3, while front and rear side walls thereof are constituted by wall portions 4*b* integrally formed with edge portions in a direction of cylinder row of the cylinder block 4 so as to connect the banks 2 and 3 to each other (FIG. 2). Meanwhile, the upper portion of the pressure buffer chamber 27 is air-tightly closed by a lid member 29 (FIG. 4) through a sealing material 28 (FIG. 3), with said lid member 29 being secured to ribs 4*c* (FIGS. 2 and 3) formed on a bottom face in the pressure buffer chamber 27 by bolts 30 (FIGS. 3, 4 and 6). At one edge portion of the above lid member 29, there is formed an opening 31 (FIG. 5), which is communicated with the intake passage 14 in the surge tank 18 through a communicating passage 33 provided with a pressure control valve 32 arranged to be opened when the intake negative pressure falls below a set value and through a suitable hose h, whereby it is so arranged that the blow-by gas in the crankcase 8 is first drawn into the pressure buffer chamber 27 by the intake negative pressure produced in the intake passage 14 at the downstream of the throttle valve 16, and thereafter, is fed into the intake passage 14 through the communicating passage 33 for combustion in the respective combustion chambers 12 together with the combustion charge.

As shown in FIG. 1(*b*), the pressure control valve 32 referred to above includes a housing 32*h* having a cap portion 32*c* connected to the downstream side of the throttle valve 17 in the intake passage 14 through the hose h, a valve body 32*a* movably accommodated in the housing 32*h*, and a spring member 32*s* provided around the valve body 32*a* for urging said valve body in one direction within the housing 32*h*, which is coupled to the communicating passage 33 as shown.

The pressure control valve 32 as described above functions in such a manner that (1) it is closed when the intake negative pressure is large as in a speed reduction at a low load period such as an idle operation or the like, (2) it is also closed when the intake negative pressure is small during a high load period, and (3) it opens the passage 33 in a normal working range for causing the blow-by gas to be drawn into the intake passage. In FIG. 1(*b*), the valve 32 is in the above state (3), and the valve body 32*a* is moved upwardly when the intake negative pressure is large, and downwardly, when the intake negative pressure is small.

According to the present invention, the space V defined by the cylinder head 11 and the head cover 11*a* at least at one side of the inclined banks 2 and 3 is communicated with the intake passage 14 at the upstream of the throttle valve 16. In the embodiment of FIG. 1, the intake passage 14 at the upstream of the throttle valve 16 and the spaces V for the respective banks 2 and 3 are communicated with each other through communicating passages 34, while the spaces V and the interior of the crankcase 8 are also communicated with each other through communicating passages 35 formed in the respective banks 2 and 3 of the cylinder block 4, whereby upon reduction of the pressure within the crankcase 8 by the suction of gas due to the intake negative pressure through the communicating passage 33, the charge (air) in the intake passage 14 at the upstream of the throttle valve 16 is introduced into the crankcase 8 through the communicating passages 4 for ventilation of the interior of the crankcase 8.

It is to be noted here that, in the arrangement of FIG. 1, air is normally introduced into the space V through the communicating passages 34, but during a high load period as at a time when the throttle valve 16 is fully opened, the blow-by gas is increased so as to conversely flow into the intake passage via the communicating passages 34. Accordingly, there are provided oil separators f including baffle plates at the inner sides of the head covers 11*a* in positions confronting the open ends of the passages 34.

Figure 5:
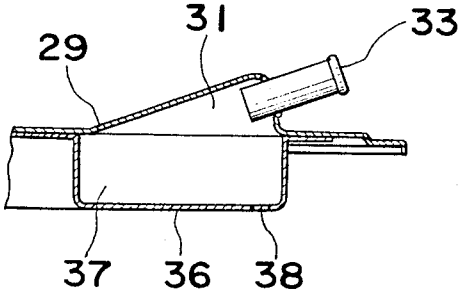

Furthermore, as shown in FIGS. 4 through 6, in the pressure buffer chamber 27, a baffle plate 36 is provided to confront the opening 31 for the communicating passage 33 into the pressure buffer chamber 27 for preventing splashes of oil within the buffer chamber 27 from being directly drawn into the passage 33, and to be integrally connected to the under surface of the lid member 29 through a predetermined space 37 in such a manner as to surround the opening 31. The baffle plate 36 is formed, at its portion corresponding to the opening 31, with an oil drain hole 38, and not only functions to prevent the oil splashes from being directly drawn into the communicating passage 33, but also constitutes a so-called oil separator 39 together with the lid member 29 (FIGS. 3 to 6). The space 37 with respect to the lid member 29 is open into the pressure buffer chamber 27 at its end portion remote from the opening 31, and is also narrowed at its portions corresponding to the two bolts 30 at the inner side for fixing the lid member 29 at the intermediate portion in the longitudinal direction thereof, whereby the blow-by gas on the way to be drawn into the intake passage 14 at the downstream of the throttle valve 16 from the pressure buffer chamber 27 is introduced into the space 37 between the lid member 29 and the baffle plate 36, and by causing the blow-by gas to collide with surrounding walls as said gas passes through the space 37 in a zigzag manner at varying flow rates, oil contained therein is removed through separation, while the oil separated from the blow-by gas is returned to the pressure buffer chamber 27 through the open portion of the space 37 and the oil drain hole 38. The cylinder block 4 is further formed with a plurality of oil return passages 40 for returning part of the oil used for lubricating the valve driving systems in the respective spaces V to the pressure buffer chamber 27.

Therefore, in the foregoing embodiment according to the present invention, even when the pressure in the crankcase 8 is varied by the increase in the explosion and expansion strokes, of the amount of the blow-by gas leaking out from the respective combustion chambers 12 of the engine 1 into the crankcase 8, and also by the pumping action of the respective pistons 6, the pressure variation in the pressure buffer chamber 27 communicated with the interior of the crankcase 8 through the communicating holes 26 is alleviated for reduction. Since the oil separator 39 constituted by the baffle plate 36 and the lid member 29 is continuously provided in the buffer chamber 27 with a small pressure variation, the oil in the blow-by gas flowing from the interior of the crankcase 8 into the pressure buffer chamber 27 is prevented from flowing into the intake passage 14 following the pressure variation, and thus, the oil separating efficiency may be improved through simple construction.

Moreover, since the pressure buffer chamber 27 provided therein with the oil separator 39 is formed between the both banks 2 and 3 of the cylinder block 4, it is possible to readily provide the pressure buffer chamber 27 of a large capacity through the effective utilization of the dead space of the V-type engine without expanding the outer side portions of the inclined banks as in the conventional practice, and thus, compact size of the engine may be advantageously achieved.

It is to be noted here that in the foregoing embodiment, although there is employed the arrangement in which the space 37 between the lid member 29 and the baffle plate 36 is varied while extending in a zigzag manner in the longitudinal direction thereof, since the pressure buffer chamber 27 has a large volume, the arrangement may be modified to employ a baffle plate of merely a single plate-like configuration which shields the opening 31 of the lid member 29 with respect to the pressure buffer chamber 27 for improvement and maintenance of the oil separating function through a simplified construction. However, for still further improvement of the oil separating function, the arrangement as in the foregoing embodiment is preferable.

It is needless to say that the present invention is not limited in its application to the V-type engine of the OHC system having six cylinders as in the foregoing embodiment, but may readily be applied to other multi-cylinder V-type engines of the OHC system.

As is clear from the foregoing description, according to the present invention, through the effective utilization of the space between the both banks of the cylinder for a V-type engine of the OHC system, there is formed the pressure buffer chamber having the cylinder block walls of the banks as the side walls thereof so as to be communicated with the interior of the crankcase, and also communicated with the intake passage at the downstream of the throttle valve through the communication passage, with the baffle plate being provided in said pressure buffer chamber to confront the open end of said communicating passage. Accordingly, the pressure buffer chamber of a large capacity may be readily obtained without expanding the respective outer side portions of the both banks as in the conventional arrangements, whereby the separating function of the oil component in the blow-by gas drawn into the intake passage may be advantageously improved, with a simultaneously reduction of the size of the V-type engine on the whole.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In a V-type internal combustion engine having cam shafts respectively provided in first spaces defined between cylinder heads and head covers of a pair of upwardly diverging cylinder banks, a breather arrangement which comprises a pressure buffer chamber provided in a second space defined between the cylinder banks of a cylinder block and including side walls constituted by cylinder block walls of said cylinder banks so as to be closed at its upper portion and communicated with an interior of a crankcase, and a communicating passage for communicating said pressure buffer chamber with an intake passage at a downstream of a throttle valve, and a oil return passage provided for each bank of said pair of upwardly diverging cylinder banks for communicating said first spaces and said pressure buffer chamber.

2. A breather arrangement as claimed in claim 1, wherein the first spaces at least at one side of said cylinder banks are communicated with the intake passage at an upstream of the throttle valve, and a passage in the cylinder banks for providing communication between said first spaces and the crankcase.

3. A breather arrangement as claimed in claim 1, wherein the upper portion of said second space is closed by a lid member which also serves as a baffle plate for an oil separator, said baffle plate is provided in said pressure buffer chamber to confront an open end of said communicating passage.

4. A breather arrangement as claimed in claim 1, wherein said communicating passage is provided with a pressure control valve for closing said communicating passage when an intake negative pressure is large.

5. A breather arrangement as claimed in claim 1, wherein said second space defined between the cylinder walls of the cylinder banks has an approximately triangular cross section, with a main oil gallery extending through the cylinder block constituting wall at its apex portion in the lower portion, said cylinder block being formed, at the side portion of said oil gallery, with a plurality of communicating holes of a comparatively small diameter for communication with the crankcase, and also, with a plurality of oil return passages for communicating said first spaces with said second space.

6. In a V-type internal combustion engine provided with first spaces defined between cylinder heads and head covers of a pair of upwardly diverging cylinder banks, a breather arrangement comprising a pressure buffer chamber provided in a second space defined between the cylinder banks of a cylinder block and including side walls constituted by cylinder block walls of said cylinder banks so as to be closed at its upper portion and communicated with an interior of a crankcase, and a communicating passage for communicating said pressure buffer chamber with an intake passage at a downstream of a throttle valve, and an oil return passage provided for each bank of said pair of upwardly diverging cylinder banks for communicating said first spaces and said pressure buffer chamber, wherein the first spaces at least at one side of said cylinder banks are communicated with the intake passage at an upstream of the throttle valve, further including a passage in the cylinder banks for providing communication between said first spaces and the crankcase.

7. A breather arrangement as claimed in claim 6, including a baffle plate provided in the pressure buffer chamber and confronting an open end of the communicating passage.

8. A breather arrangement as claimed in claim 7, including a pressure control valve for closing said communicating passage when the communicating passage has a small negative intake pressure.

9. A breather arrangement as claimed in claim 8, wherein said baffle plate confronts the open end of said communicating passage for communicating said intake passage upstream of the throttle valve with at least one of said first spaces.

10. A breather arrangement as claimed in claim 6, wherein said first spaces defined in said pair of upwardly diverging cylinder banks and the upstream of the throttle valve are in communication with each other.

11. In a V-type internal combustion engine having cam shafts respectively provided in first spaces defined between cylinder heads and head covers of a pair of upwardly diverging cylinder banks, a breather arrangement comprising a pressure buffer chamber provided in a second space located between the cylinder banks of a cylinder block and including side walls constituted by cylinder block walls of said cylinder banks so as to be closed at an upper portion and communicated with an interior of a crankcase, and defining an approximately triangular cross-section, a communicating passage for communicating said pressure buffer chamber with an intake passage provided downstream of a throttle valve, the communicating passage provided with a pressure control valve for closing the communicating passage when an intake negative pressure is large and when the intake negative pressure is small, the communicating passage open at all other times of operation, a baffle plate provided in said pressure buffer chamber to confront an open end of said communicating passage and including a lid member for said baffle plate for separating oil from blow-by gas drawn from said crankcase and returning said oil to said breather chamber, said first spaces at least at one side of said banks in communication with the intake passage upstream of the throttle valve, a passage provided in the cylinder banks for providing communication between said first spaces and the crankcase, a main oil gallery extending through the cylinder block walls in an apex portion of said walls and, said cylinder block defining, at a side portion of said oil gallery, a plurality of communicating holes for communication with the crankcase.

* * * * *